United States Patent [19]

Rapp

[11] Patent Number: 4,831,711

[45] Date of Patent: May 23, 1989

[54] METHOD FOR JOINING THIN PLATES STACKED ON ONE ANOTHER

[76] Inventor: Eugen Rapp, Max-Reger-Str. 4, 7981 Berg, Fed. Rep. of Germany

[21] Appl. No.: 176,552

[22] Filed: Apr. 1, 1988

[30] Foreign Application Priority Data

Apr. 1, 1987 [DE] Fed. Rep. of Germany ..... 3710929

[51] Int. Cl.[4] ..... B21D 39/03

[52] U.S. Cl. ..... 29/509; 29/521; 29/522.1; 403/285

[58] Field of Search ..... 29/432, 432.1, 432.2, 29/509, 521, 522; 403/285

[56] References Cited

U.S. PATENT DOCUMENTS

| | | | |
|---|---|---|---|
| 2,122,557 | 7/1938 | Canter | 29/521 |
| 3,404,648 | 10/1968 | Rosbottom | 29/522.1 X |
| 3,771,216 | 11/1973 | Johnson | 29/522.1 X |
| 4,531,279 | 7/1985 | Gunter | 29/509 |
| 4,757,609 | 7/1988 | Sawdon | 29/509 X |
| 4,760,634 | 8/1988 | Rapp | 29/509 |

FOREIGN PATENT DOCUMENTS

| | | | |
|---|---|---|---|
| 106437 | 7/1982 | Japan | 29/521 |

*Primary Examiner*—Mark Rosenbaum
*Assistant Examiner*—Andrew E. Rawlins
*Attorney, Agent, or Firm*—Edwin E. Greigg

[57] ABSTRACT

Method and apparatus for fastening thin plates (4, 5) overlying one another, via a fastening element formed from the material, which element is obtained by partial stamping separation and/or deforming of plate areas (10, 11) out of the plate plane via a male die (1, 21; 26) and a female die (2, 3, 23 and 31, 32) with subsequent compressing of the plate areas, wherein the plate areas (10, 11) that as the fastening element grip the stamping or deforming hole from behind are leveled into the plate plane, so that after the machining, on the outer surface of the plates that have been fastened together, no nubs remain that are noticeable from the outside.

3 Claims, 2 Drawing Sheets

METHOD FOR JOINING THIN PLATES STACKED ON ONE ANOTHER

BACKGROUND OF THE INVENTION

The invention is based on a method for fastening thin plates (in particular metal sheets) overlying one another, as generically defined herein.

This generic fastening technique has manifold applications, because it can be done without additional auxiliary fastening elements such as rivets, screws and the like, yet without impairing the quality of the fastening. Such fastenings are capable of being subjected not only to considerable tensile forces but to shear forces as well, and always have, in addition to the positive interlock by force, a positive interlock because of shape at the fastening site between the plates; nevertheless, despite all the advantages, there is still one disadvantage, which is that a bump formed by the fastening element protrudes from the plate plane, so that this type of fastening technique cannot be used universally. Other elements can catch on these bumps, or the bumps may represent undesirable protrusions, for example on parts that are to be painted.

A known method of this generic type (U.S. Pat. No. 3,934,327) produces stamped cams, in which a deforming and stamping process is followed by a compressing process, wherein the plate piece closer to the plates is widened by compression and with its edges grips the plates from behind (clinching). So that the sheet-metal bump will protrude as little as possible from the plate plane, an indentation is impressed into the plates by additional pressing tools, and the stamped cam is then formed inside this indentation, so that the fastening parts of the cam protrude insignificantly beyond this indentation. The disadvantage in any case is that protrusions are now present on both sides of the plates to be fastened; thus the above-addressed problem is not overcome, but only shifted elsewhere.

In another known generic method and corresponding apparatus (German Published, Unexamined Patent Application No. DE-OS 35 32 900), only a limited volume, which is determined by the size of a blind opening in the forging die, is available for the fastening element to the extent that it protrudes from the plate plane. Although this method does attain a firm fastening with only little protrusion of the sheet-metal bump, with at least one smooth plate side, nevertheless the disadvantage of this nub on the fastening element remains.

SUMMARY OF THE INVENTION

The method according to the invention has the advantage over the prior art that after the fastening of the plates, there are no parts such as sheet-metal bumps protruding from the plate plane, and the remaining blind openings on the plate surface against which the male die is used have become smaller than in the known methods and furthermore are of lesser importance. By the use of the invention, this fastening technique can thus be much more widely used, yet is not substantially more expensive. A substantial and above all unexpected advantage of the invention is that by means of the additional deformation of material in the fastening element, a considerable increase in strength, in particular shear strength, is attained, which can be up to 100% in comparison with an unleveled fastening. Furthermore, the dynamic strength is also improved. The additional expense in the use of the invention, for example entailed by providing a multistation system, or in a one-station system entailed by changing the tools, recedes to the background by comparison with the advantages obtained in most cases, even when an already highly efficient method like the known method described above is involved.

The apparatus according to the invention has recourse to experience that has long been available in this fastening techinque, namely using two-part tools having a female die having a displaceable bottom serving on the one hand as a forging die bottom and on the other hand, in the leveling process, as a male die bottom. In principle, the same is true for the male die itself, which at the beginning of the fastening process performs its stamping function and then, in the leveling process, by slight retraction, functions as a sizing die. Naturally the guide element surrounding the actual male die, for example a bush, can be moved onto the plates already at the beginning of the deforming process or the stamping process, in order to firmly chuck them together with the female die tool.

In a further feature of the invention, this male die is resiliently supported in the guide element in the force direction; the resiliency comes into effect only at the leveling force, so that in the deforming and compressing processes the male die in the guide element remains in its position relative to the guide element and only yields once the strong leveling force is brought to bear from the female die side, in order to furnish sufficient space for the material that has been compressed out of the way.

The apparatus has the advantage over the known apparatuses of requiring relatively less additional tool expense, and of allowing simple tools to be used, which has a favorable effect upon the service life of these tools, in particular.

According to the invention a rolling apparatus can also be used for the leveling, in particular having a pair of rollers, one of which has a smooth surface while the other roller has sizing mandrels, which engage the blind openings already created by the fastening process performed beforehand.

Further advantages and advantageous features of the invention will become apparent from the ensuing description, and from the drawing and the claims.

BRIEF DESCRIPTION OF THE DRAWINGS

Three exemplary embodiments of the subject of the invention are shown in the drawing and described in further detail below. Shown are.

DESCRIPTION OF THE PREFERRED EMBODIMENTS

Figure 1:
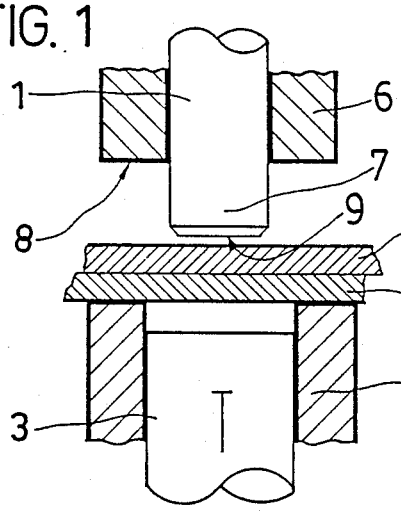
FIGS. 1–5, the first exemplary embodiment having a tool generating a round fastening point, seen in longitudinal section and in five different work positions of a work station.

In FIGS. 1–6, the first exemplary embodiment is shown as an example of a tool; only the actual manufacturing tool is shown, along with the plates to be fastened, in five different work positions. Naturally, for the sake of completeness of the invention, the pressing apparatus is also needed, which may be embodied in the most various manner and by means of which, to perform the fastening according to the invention, the tool must be actuated.

The tool comprises a male die 1, a female die 2 and an anvil 3, which is displaceable relative to the female die 2. The plates to be fastened are present between the male die 1 and the female die 2, the plates being a lower plate 4 and an upper plate 5. These plates are typically metal sheets, but naturally more than two such sheets can also be fastened together.

A bush 6 (guide element) is disposed surrounding the male die 1 and is displaceable relative to the male die 1. Protruding from the bush 6 is a working tang or leveling die 7, suitably variable in length. The shoulder 8 of the bush 6 is oriented toward the upper plate 5, as is the end face 9 of the working tang 7.

Figure 2:
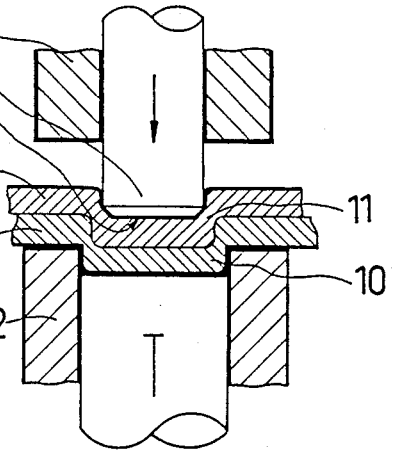

In FIG. 2, the first portion of the work process, namely the deforming, has ended; in this part the working tang 7 has deformed the plate areas 10 or 11, disposed in front of its free end face 9, of the two plates 4 and 5 by forcing the plates into the area above the anvil 3 to make a blind opening. In this process a cup-shaped fastening is produced between the plates remaining in the original position and the deformed plate areas 10 and 11, and a corresponding thinning of material of these areas has taken place, without any interlocking of the plates 4 and 5 having been effected.

Figure 3:
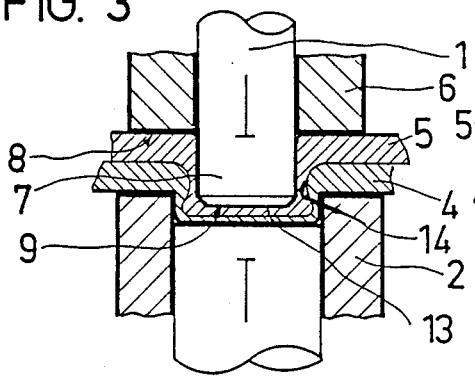

In FIG. 3, the forming male die 1 assumes its final position, in which the deformed plate areas 10 and 11 have already been compressed. In this position, the shoulder 8 rests on the surface of the plate 5. The plate areas facing the end face 9 are severely compressed by the resistance of the anvil 3 and the limiting female die 2, the material having been positively displaced radially outward. Because of the compressing effect, the deformed plate areas have been radially stretched, so as to make a compressed element here shown horizontally, far enough that this compressed element grips the deformed opening 14 of the lower plate from behind. An extremely firm shape-defined interconnection is already attained after this working step, as a result of the flowing together of the plate material.

Figure 4:
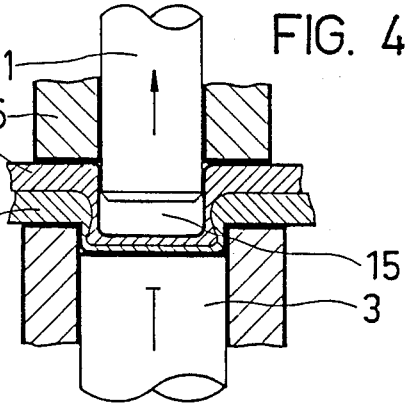

In FIG. 4, the forming male die 1 is raised slightly upward inside the bush 6, creating a hollow space 15.

Figure 5:
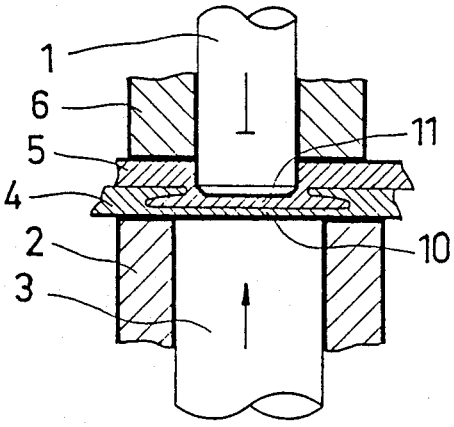

In FIG. 5, the tool assumes the final position after a leveling process of the two plate areas 10 and 11, that is, after the entire machining, in which the anvil 3 is pushed upward as far as the plane of the plates 4 and 5, which positively displaces the deformed areas 10, 11 into the plate plane. The positively displaced material fills up the previously formed hollow space 15, the forming male die 1 functioning as a sizing die and the bush 6 functioning as a resistance support.

Naturally it is also conceivable that in this leveling process shown in FIGS. 4 and 5, the female die 2 is first retracted with its end face as far as the end face plane of the anvil 3, and after that, forming a flat pressing die, which is displaced for the leveling process back in the direction of the forming male die 1 or bush 6 for leveling.

Figure 6:
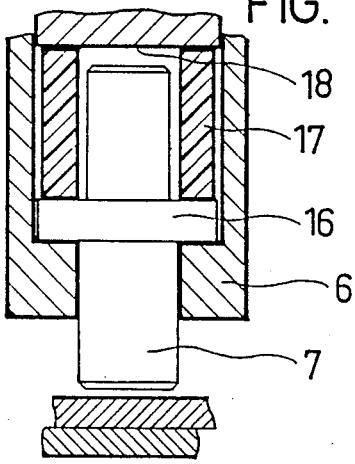
FIG. 6, an embodiment of the male die of this tool.

In FIG. 6, an embodiment of the bush 6 and leveling die 7 is shown, in which the leveling die 7 is supported via a collar 16 on an elastic material 17, for example a spring, and in which its stroke is limited by a stop 18. This elastic material 17 is embodied such that it does not yield in the deforming and compressing processes, but yields only in the leveling process, that is, upon the displacement of the anvil 3 in the direction of the plates 4, 5. As a result, an extra tool actuating the forming male die 7 inside the bush 6 can be dispensed with.

Figure 7:
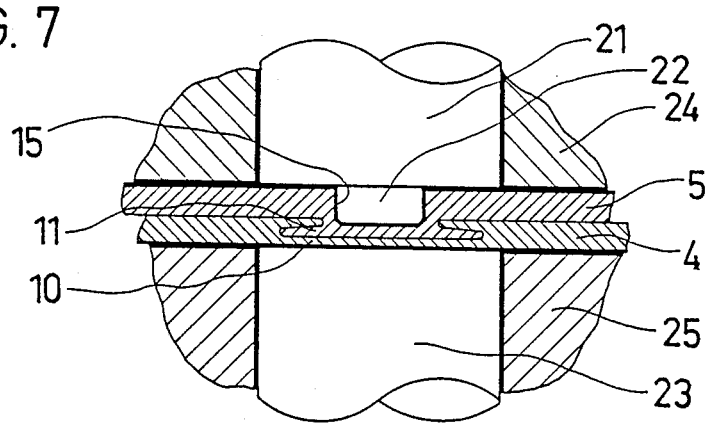
FIG. 7, the second exemplary embodiment in a longitudinal section in the final position of the tool in a multi-work-station method.

In FIG. 7, a second exemplary embodiment is shown in which the leveling process is performed at a separate work station. At the first work station, the steps shown in FIGS. 1-3 are performed, while here at the separate work station only the leveling process shown in FIG. 5 is performed by itself. To this end, a special sizing die 21 is present, having a sizing tang 22, and an extra leveling die 23 is provided, the plates 4 and 5 being held in place by chucking devices 24 and 25. Since the plates were already fastened together by the fastening element, these chucking devices 24 and 25 primarily serve to effect accurate introduction of the sizing die 21 into the existing blind opening 15. The diameter of the leveling die 23 in each case is large enough that it covers the sheet-metal bump formed by the fastening, or the deformed plate areas 10 and 11.

Figure 8:
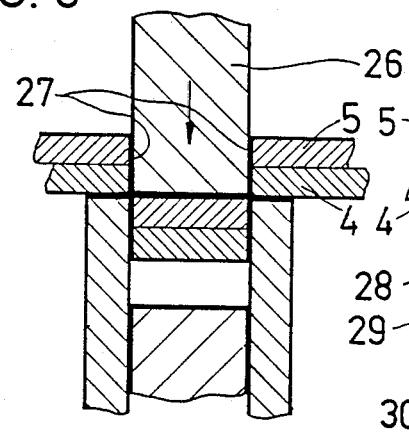
FIGS. 8–11, the third exemplary embodiment in three different work positions and in longitudinal section.
Figure 9:
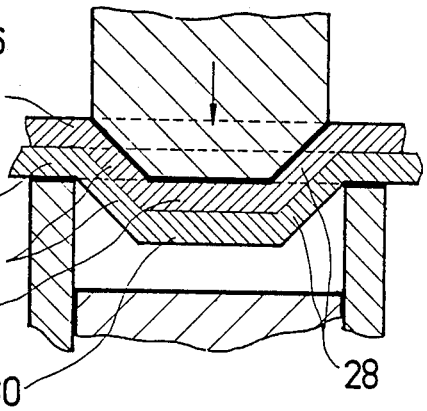

In FIGS. 8-11, the third exemplary embodiment is shown, in which a stamped cam is subsequently leveled. A stamping and pressing die 26, which is movable back and forth by suitable devices, cuts through the plates 5 and 4 at the points 27 and leaves remaining lateral sections 28 which are merely deformed. While FIG. 8 shows a cross section in which the cut portions can be seen, FIG. 9 shows a section rotated by 90° from FIG. 8, in which the deformed fastening can be seen.

Figure 10:
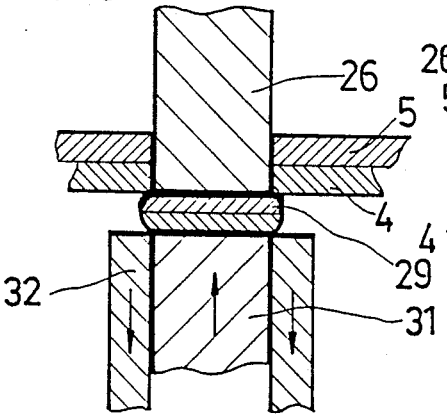

FIG. 10 shows how the pressed-out sheet-metal parts 29 and 30 are compressed by the driving upward of an anvil 31, the stamping and pressing die 26 remaining stationary. At the cut portions, at least the sheet-metal section 29 is thereby widened and thus grips the lower plate 4 from behind. To enable a flow of material, the female die 32 is moved slightly downward for this compressing process.

Figure 11:
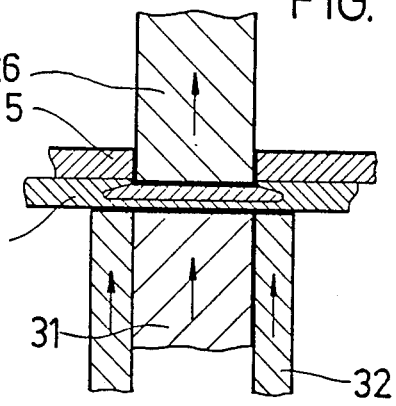

FIG. 11 then shows the leveling course once again, in which the stamping and pressing die 26 is driven slightly upward, so as to provide a space for receiving compressed material, and in which the anvil 31 and the female die 32, now forming a common pressing die, are displaced as far as the plane of the plates 4 and 5.

All the characteristics in the description, the following claims and shown in the drawing can be essential to the invention both individually and in any arbitrary combination with one another.

I claim:

1. A method for fastening together at least two thin plates overlaying one another, such as metal sheets, in which plate areas of the plates rest over a large surface area on one another, in order to form a fastening element, which comprises the following steps:

directing a male die to contact a first plate on an entry side, toward a female die, which contacts a second plate, thereby partially deforming said plate areas out of the plane of said plates at a deforming area until the male die has displaced at least a portion of the second plate and at most a portion of the first plate from the entry side beyond the plane of said second plate to form a sheet metal bump;

compressing said plate areas together, wherein at least a surface of one of the plate areas oriented toward the male die is compressed widthwise and thereby is imparted a larger crosswise dimension than that of the deforming area; and moving said male die a distance to leave a space between an end of said male die and the deformed area, and forcing said deformed area toward said male die thereby forcing the deformed area of the sheet-metal bump formed from the plate areas into the plane of the plates, thereby filling the space and fastening the plates.

2. A method as defined by claim 1, in which the forcing in of the sheet-metal bump takes place at the same work station, by varying a location of the female-die and male-die bottom counter to the entry direction.

3. A method as defined by claim 1, in which the forcing in of the sheet-metal bump is performed at a subsequent work station, with a leveling surface positioned relative to the sheet-metal bump.

* * * * *